US005230504A

United States Patent [19]

Schmaling

[11] Patent Number: 5,230,504

[45] Date of Patent: Jul. 27, 1993

[54] DOCUMENT REGISTRATION APPARATUS WITH ADJUSTMENT FOR HANDLING DOCUMENTS OF DIFFERENT LENGTHS

[75] Inventor: Roderick N. Schmaling, Brookfield Center, Conn.

[73] Assignee: Pitney Bowes Inc., Stamford, Conn.

[21] Appl. No.: 906,170

[22] Filed: May 29, 1992

[51] Int. Cl.[5] ..... B65H 9/04

[52] U.S. Cl. ..... 271/246; 414/789

[58] Field of Search ..... 271/245, 247; 414/789; 198/463.4, 434

[56] References Cited

U.S. PATENT DOCUMENTS

| | | | |
|---|---|---|---|
| 824,755 | 7/1906 | Sturtevant . | |
| 3,136,325 | 6/1965 | Belder | 271/246 X |
| 3,637,203 | 1/1972 | French | 271/53 |
| 3,661,383 | 5/1972 | Morrison | 271/51 |
| 4,073,391 | 2/1978 | O'Brian et al. | 271/246 X |
| 4,078,790 | 3/1978 | Stocker | 271/213 |
| 4,533,135 | 8/1985 | Barker | 271/275 |
| 4,570,923 | 2/1986 | Hooper et al. | 271/275 |
| 4,606,536 | 8/1986 | Ohara | 271/118 |
| 4,630,815 | 12/1986 | Petersen et al. | 271/273 |
| 4,750,853 | 6/1988 | Van Soest et al. | 414/43 |
| 4,815,726 | 3/1989 | Pagowski et al. | 271/274 |
| 5,080,347 | 1/1992 | Funada | 271/246 X |

FOREIGN PATENT DOCUMENTS

| | | | |
|---|---|---|---|
| 0280150 | 12/1987 | Japan | 271/246 |
| 0171738 | 7/1988 | Japan | 271/246 |

*Primary Examiner*—H. Grant Skaggs
*Assistant Examiner*—Carol L. Druzbick
*Attorney, Agent, or Firm*—Charles R. Malandra, Jr.; Melvin J. Scolnick

[57] ABSTRACT

A document registration apparatus for use in a document inserting station or a document queuing station is provided. The apparatus includes a document registration unit having a plurality of laterally-spaced registration stops which pivot about a horizontal axis for stopping motion of a document and registering a particular edge of a document to a particular direction in the apparatus. The registration unit also includes at least one urge roller for moving the registered document away from the apparatus for further processing. The document registration apparatus also includes structure for adjusting the position of the document registration unit for handling different length documents. The apparatus further includes structure for pivoting said documentation registration unit about a vertical axis for skew adjustment of said registration unit.

28 Claims, 8 Drawing Sheets 10
27
28
15
14
25
25A
12
13
13
31
20
20B
16
49
A
21
B
32
34
D
11

DOCUMENT REGISTRATION APPARATUS WITH ADJUSTMENT FOR HANDLING DOCUMENTS OF DIFFERENT LENGTHS

RELATED APPLICATIONS

The present application is related to U.S. application Ser. No. 07/906,200, filed concurrently herewith; and U.S. application Ser. No. 808,863, filed Dec. 17, 1991, each of which co-pending applications is assigned to the assignee of the present invention. The specific and entire disclosure each of the aforementioned applications is specifically incorporated herein by reference for the purpose of further explaining the nature of the present invention.

FIELD OF THE INVENTION

The present invention relates to a document registration apparatus for use in a document processing system, and more particularly, for use in a document queuing station.

BACKGROUND OF THE INVENTION

Various document processing systems, such as in an inserting machine, require that a document is aligned relative to a particular station in the system prior to being processed at the station. Typically, this is accomplished by registering a particular edge of the document in a particular direction in the system. For example, documents must be aligned before being conveyed to a folding apparatus to achieve a proper fold. Also, enclosures which are to be inserted into an envelope should be aligned relative to the envelope prior to insertion in order to avoid processing difficulties. Furthermore, some documents which are to be transported away from a particular queuing station, to another adjacent document raceway, should be aligned at the queuing station relative to the raceway, in order to facilitate the processing of the documents.

Devices which register a particular edge of a document to a particular direction are known. See, for example, U.S. Pat. Nos. 3,637,203, 4,078,790 and 4,925,180, which utilize stops that pivot into position to stop the advancement of documents being conveyed in a particular direction. Some registration devices, such as stationary side guides, perform the task of aligning the document while the document is being conveyed. Other devices, such as a "queuing" station, perform the dual task of aligning the document and stopping the document until the next successive station is ready to receive the document for further processing. Typically, queuing stations comprise mechanisms which register the document by stopping, i.e., queuing, the document. Queuing stations are typically configured to handle documents of a particular length and are not easily reconfigured to handle sheets of a different length. Queuing stations are generally comprised of a complex mechanical design that is subject to frequent mechanical failure. For this reason, a reconfiguration of a queuing station normally requires a service call by a skilled technician.

In U.S. patent application Ser. No. 808,863, filed on Dec. 17, 1991, and assigned to the assignee of the present invention, a document registration apparatus in the form of a queuing station is disclosed. The apparatus has a plurality of registration stops for stopping the conveyance of a document and registering a particular edge of a document to a particular direction in the apparatus.

The registration apparatus also includes at least one urge roller for moving the registered document away from the apparatus for further processing. The document registration apparatus also includes a jam access hinge for providing access to a jammed document. However, the apparatus disclosed in U.S. patent application Ser. No. 808,863 does not include means for adjusting the apparatus to queue and register documents of various lengths.

A drawback present in some known document registration devices is that it can be difficult to adjust the device to the proper alignment. It is well known that there is a need to adjust such registration devices for skew. Adjusting for skew aligns the registration device so that the document is conveyed from the registration device parallel with the center line of the paper path. For a stationary device, such as with side guides, this would not be a difficult task. However, for other devices, such as a queuing station which comprises a plurality of components and performs multiple tasks, each of the individual parts must be aligned relative to each other in order for the overall apparatus to be properly aligned to a particular chosen direction without interfering with the stopping mechanism. Once the alignment is set at a station, further adjustments may become necessary to maintain alignment. Furthermore, adjustments may be needed when the type or size of documents being processed is changed, or when the registration device goes out of alignment causing skewing of the documents at the next successive station. When the number of parts in the registration device is large, the alignment adjustment can be time consuming.

A document registration apparatus which simultaneously queues and aligns a stack of documents can also suffer from other drawbacks associated with the mechanical design of the apparatus. For example, the design and operation of a queuing station may result in undesirable "shingling" of documents where the top document in the stack is not directly above the lower documents but slightly shifted forward or backward. This can occur, for example, when the exit pinch rollers are mounted in such a way that the transport system cannot maintain a square alignment when a document stack exits the station.

A document registration apparatus, such as a queuing station, that is configured for documents of a particular length typically is not easily reconfigured or adjusted to handle documents of a different length.

SUMMARY OF THE INVENTION

In light of the above, it has been found that a document registration apparatus, which is not subject to frequent mechanical failure because of the nature of its mechanical design, can include structure which facilitates adjustment for document length. It has further been found that such document registration apparatus can also include a plurality of stops as part of a skew adjustment mechanism which adjusts for skew by pivoting the plane of the stops by a turn of a screw.

Thus, the present invention includes a unique feature to adjust a queuing station registration apparatus for handling documents of different lengths. The present invention provides a document registration apparatus that includes separate length adjustment and skew adjustment, which are operator adjustable and which maintain an adjustment once set.

In accordance with the present invention there is provided a document registration apparatus for use with a conveying means for transporting a document along a path from an upstream direction to a downstream direction through a document registration position. The document registration apparatus includes a document registration unit positioned above the document registration position in the document path, a plurality of laterally-spaced registration stops at the downstream end of the registration unit positioned substantially perpendicularly to the document path for both stopping a document at the document registration position and for aligning the document relative to the document path when the registration stops are lowered adjacent to the document path, and at least one urge roller at the upstream end of the registration unit for urging a stopped document against the conveying means when the stops are raised above the document path to move the document from the document registration position in the downstream direction. The document registration unit further includes a first pivoting means for pivoting the stops about a horizontal axis in the registration unit for selectively lowering and raising the stops adjacent to the document path, and a plurality of unit pinch rollers positioned adjacent to and downstream from the registration stops for urging the document against the conveying means as the document is conveyed away from the document registration position in a downstream direction.

The document registration apparatus further includes a top plate having a longitudinal slot with the registration unit being mounted to the top plate by a bracket extending through the slot. A plurality of exit pinch rollers are pivotally mounted to a downstream section of the top plate for urging the document against the conveying means as the document is conveyed away from the document registration apparatus. There are adjustment means operatively connected to the bracket for moving the bracket along the slot wherein the document registration unit is moved to a position within the document registration apparatus for handling a particular length of the document.

The document registration apparatus may also include at least one pair of interior pinch rollers that are individually mounted to one end of respective support arms. The other end of the support arms are pivotally mounted to the top plate, whereby the interior pinch rollers are raised and lowered when the registration unit is moved to a new position.

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE INVENTION

Figure 1:
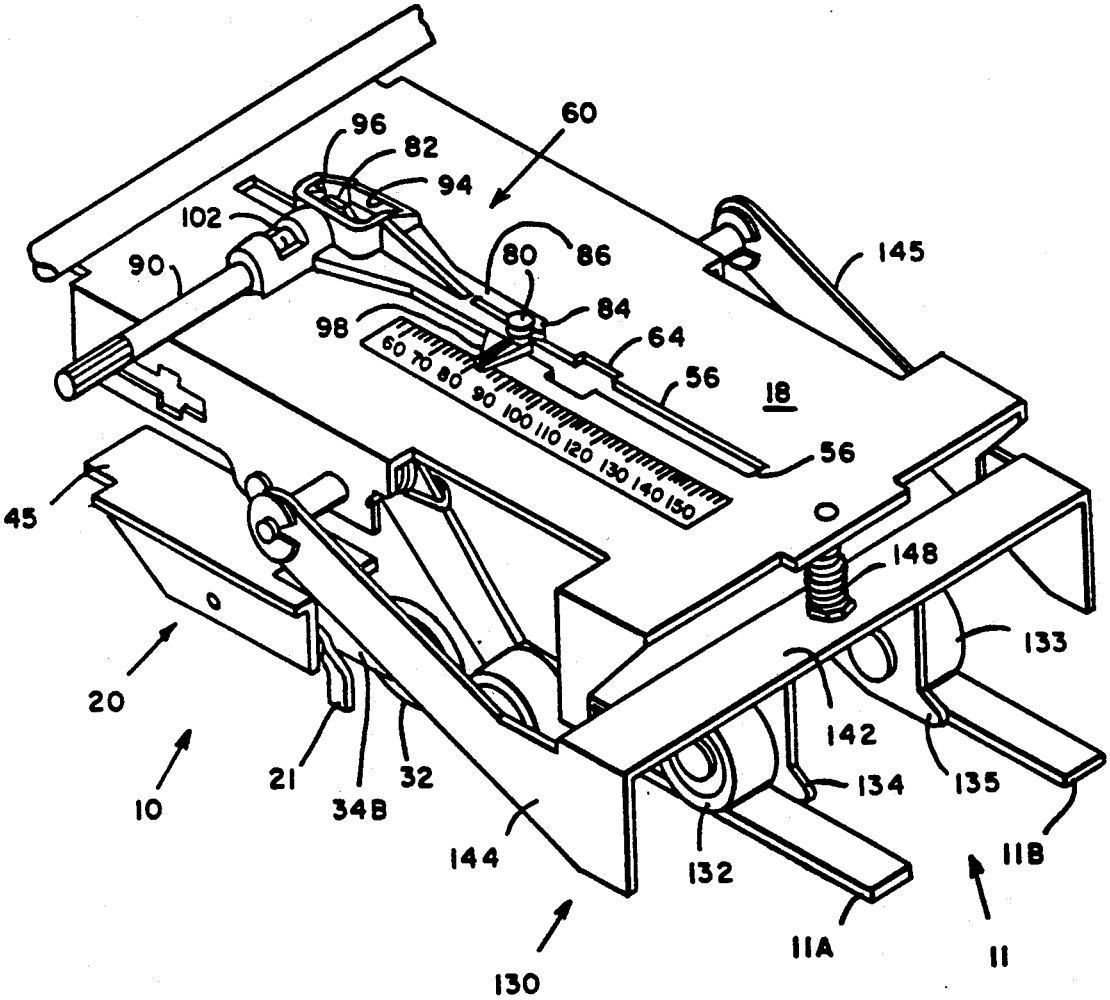
FIG. 1 is a perspective view of the preferred embodiment of a document registration apparatus according to the present invention.

The present invention is part of a document processing system, such as an inserting machine, comprising a plurality of stations situated successively along a paper path for processing documents conveyed along the path. With reference to FIGS. 1-10, a document registration apparatus, generally shown as 10, is used in conjunction with a document transport system, generally designated 11. As shown in FIG. 3, registration apparatus 10 cooperates with transport system 11 in transporting a document 12 along a path 13 in an upstream to downstream direction, designated as arrow D. There is a document registration position 16 where document 12 is stopped in its path by registration unit 10 and is held or "queued" until the next successive station in the processing system is ready to process document 12.

The apparatus 10 simultaneously stops and aligns the document 12 conveyed by transport system 11. Document registration apparatus 10 aligns document 12 relative to path 13, or, if desired, some other document raceway in the system. Although FIG. 3 shows a single document 12, it is to be understood that the present invention is applicable to situations where document 12 is a stack of documents.

Document registration apparatus 10 is suitable for use in a queuing station, for example after a sheet feeder or an enclosure feeder, or in an inserting station of an inserting machine wherein document 12 must be stopped and aligned before further processing. Apparatus 10 is suitably mounted to the frame (not shown) of the inserting machine. For example, apparatus 10 can be pivotally mounted at the upstream end to provide easy access for document jams. A more detailed description of such an arrangement is provided in U.S. application Ser. No. 808,863, noted previously herein.

Figure 2:
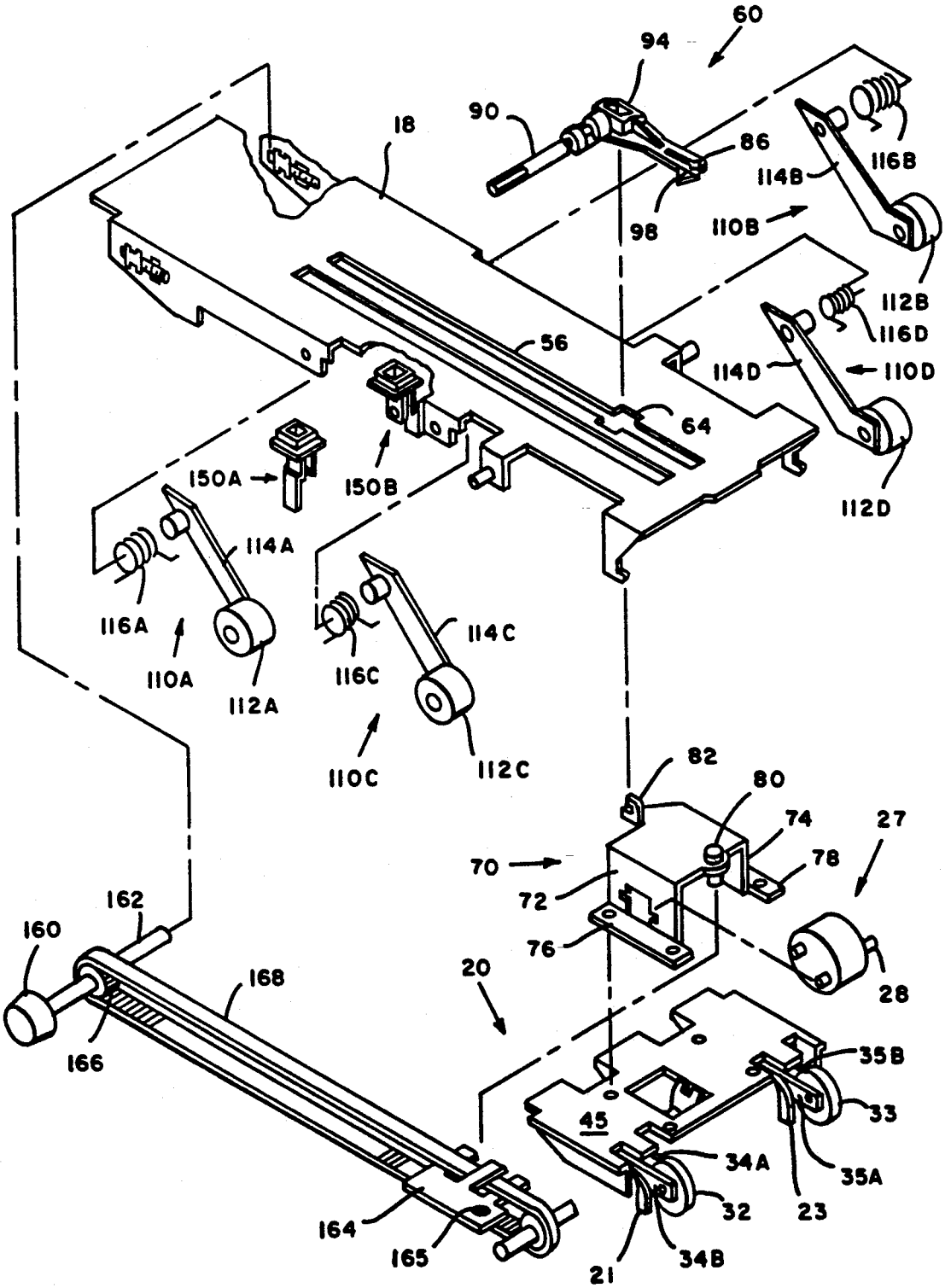
FIG. 2 is an exploded perspective view of the document registration apparatus similar to that shown in FIG. 1 but longer in length.
Figure 3:
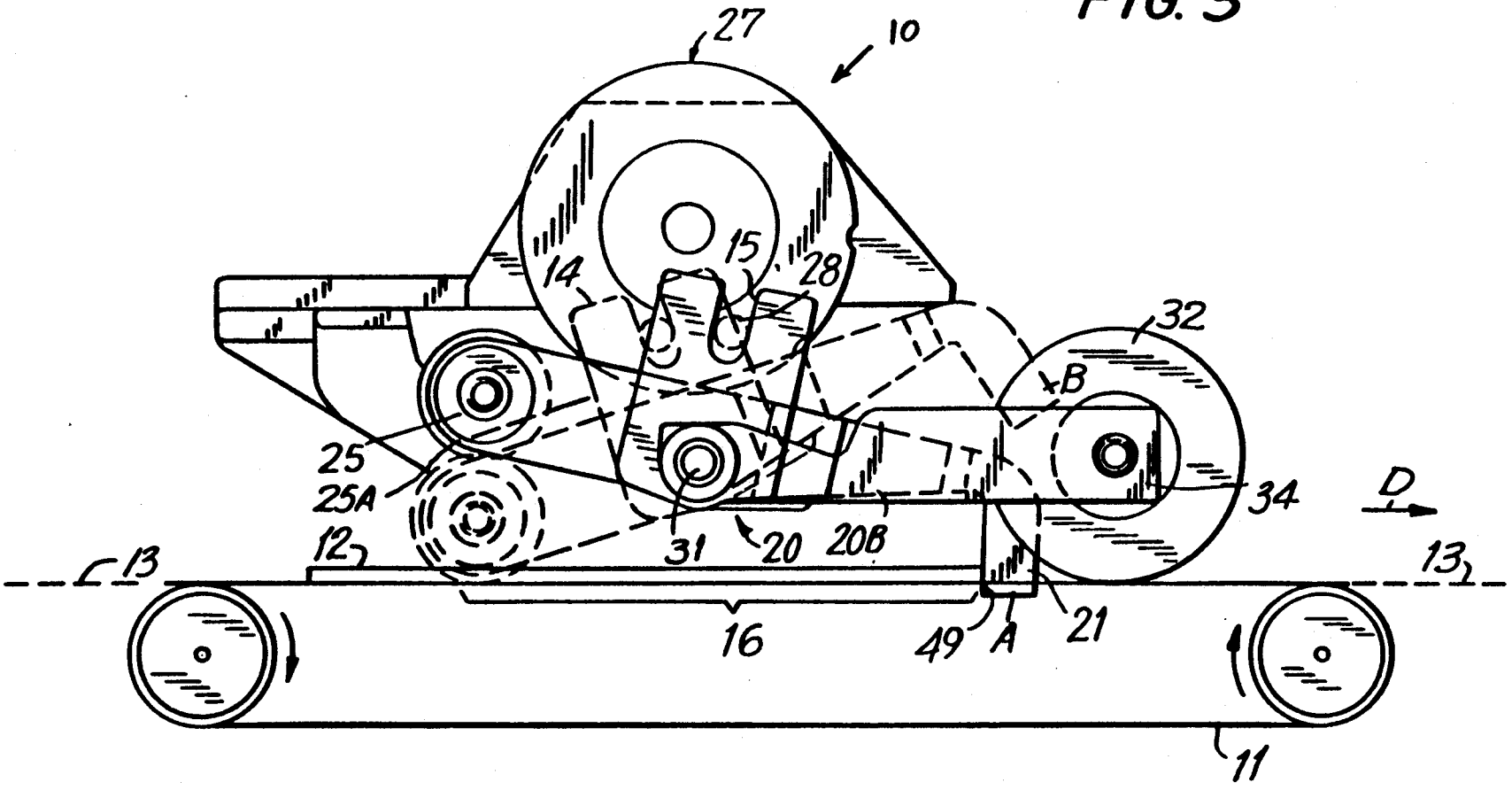
FIG. 3 is a partial side elevational view of the document registration apparatus of FIG. 1.
Figure 4:
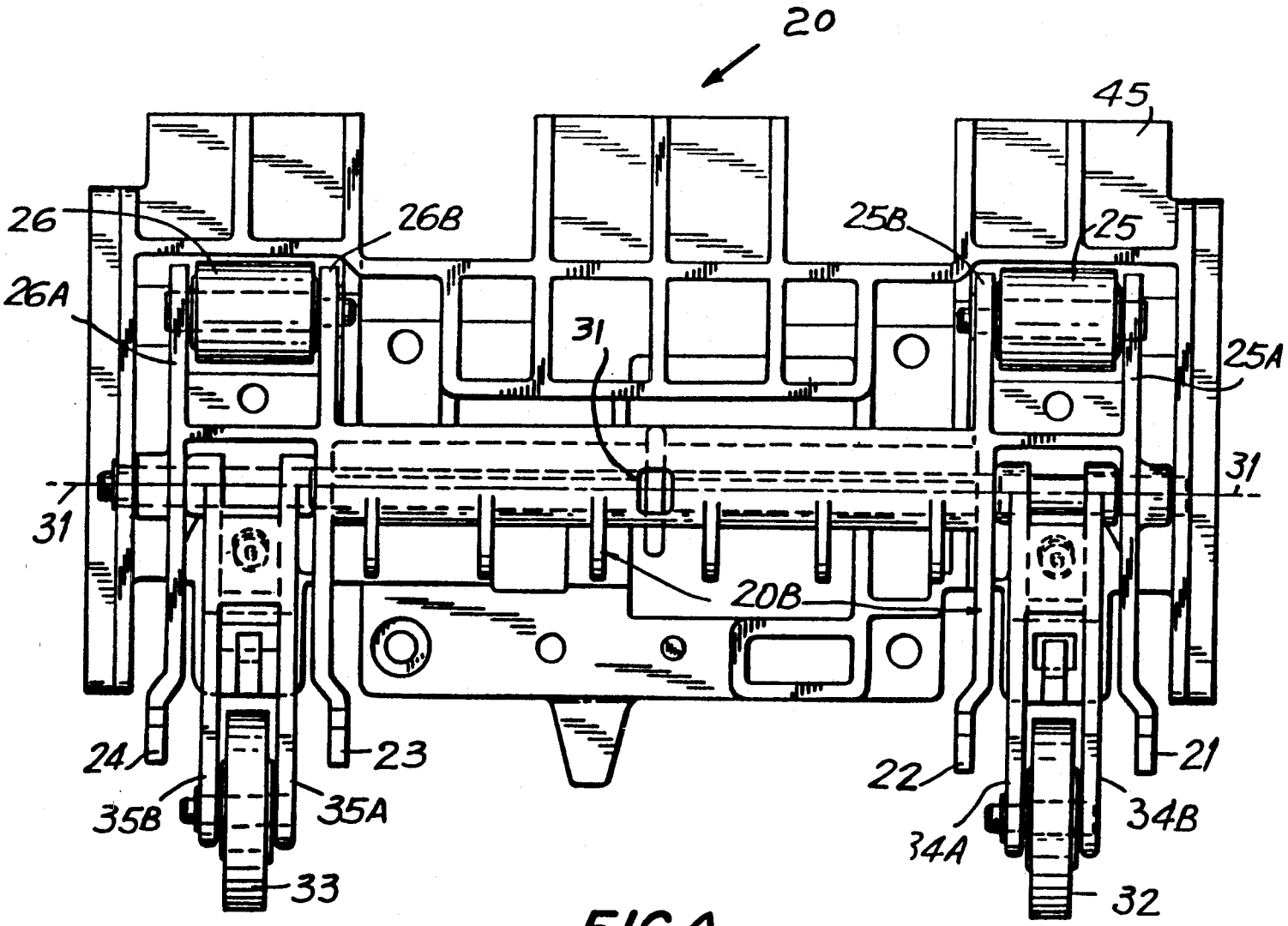
FIG. 4 is a bottom view of a registration unit of the document registration apparatus of FIG. 1.
Figure 5:
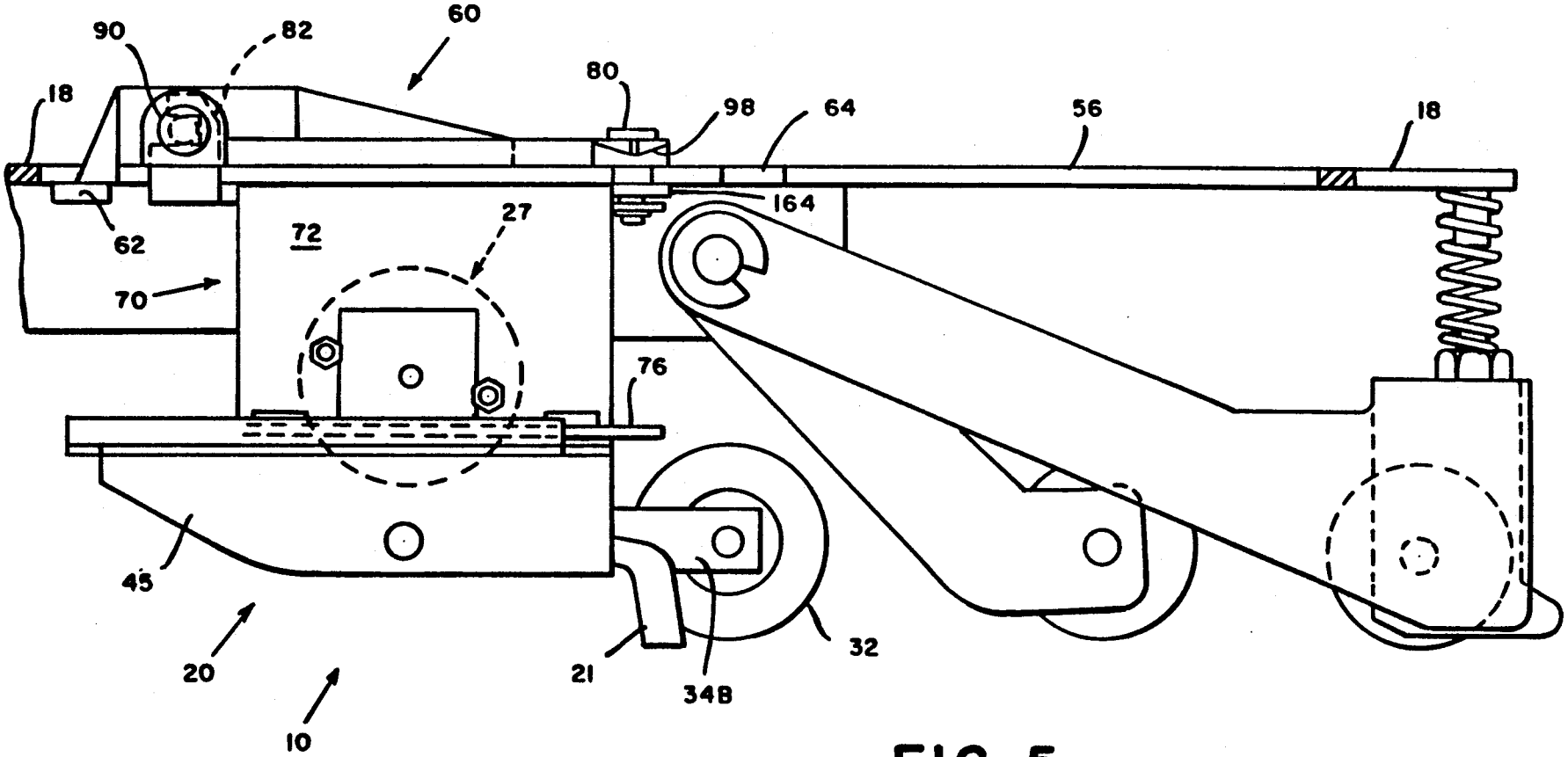
FIG. 5 is a partial side elevational view of the registration apparatus of FIG. 1, showing the relationship among the components effecting the length adjustment.

Referring now to FIGS. 2, 3 and 4, apparatus 10 comprises a document registration unit 20 pivotally mounted to a top plate 18. Document registration unit 20 includes four registration stops 21, 22, 23 and 24 on the downstream end thereof and two urge rollers 25 and 26 on urge roller arms 25A-B and 26A-B, respectively, on the upstream end of unit 20. Urge rollers 25 and 26 are spaced at lateral positions between the lateral positions of registration stops 21 and 22 on the one hand, and the lateral positions of registration stops 23 and 24 on the other hand, respectively. Registration unit 20 pivots vertically around pivot axis 31. A rotary solenoid 27 is linked to a pivoting arm 14 by a pin 28 which rides in a slot 15 of pivoting arm 14. Pin 28 moves along a circular path on each actuation of solenoid 27 and reciprocates in slot 15, thereby rocking pivot arm 14. As pivot arm 14 rocks, document registration unit 20 pivots vertically around pivot axis 31.

The combination of registration stops 21–24 and urge rollers 25 and 26 are used to stop and align document 12 at document registration position 16, and then to release it for further processing. The stopped document 12 is aligned at this position so that it can subsequently be processed with minimal skew relative to path 13 or, if desired, some other document raceway as discussed above. For example, if document 12 is an envelope to which enclosures will be inserted, then registration stops 21–24 ensure that the envelope will be aligned relative to the enclosures. This insertion process can take place at document registration position 16 (where the envelope will be held open by an envelope opening claw) or, if desired, at a subsequent location along path 13. Similarly, if document 12 is an enclosure which will be subsequently inserted into an envelope, then registration stops 21–24 ensure that the enclosure will be aligned relative to the envelope. Finally, if document 12 is a sheet or stack of sheets which will subsequently be folded, then registration stops 21–24 ensure that the document is aligned so that the folder can make a square fold of the document.

The registration units shown in FIGS. 1 and 2 are comprised of different lengths with each being suitable for a particular use. For example, the longer apparatus in FIG. 2 may be more suitable for use with a sheet feeder that can feed sheets of different lengths. The shorter apparatus in FIG. 1 may be more suitable at an insertion station for handling an envelope, or at an enclosure feeder when the length of the document being fed is less than full size sheets.

In order to stop document 12 at document registration position 16, registration stops 21–24 are urged clockwise to position A (FIG. 3) by actuating solenoid 27. In position A, registration stops 21–24 extend into document path 13 and preferably project below the plane of transport system 11, so as to block document 12 from being transported further downstream by transport system 11. In the preferred embodiment, transport system 11 includes two transport belts 11A and 11B (FIGS. 1 and 7) which move in synchronization. Preferably, transport belts 11A and 11B are each approximately 0.5 inch wide. Laterally spaced on each side of each transport belt 11A and 11B are registration stops 21, 22 and 23, 24, respectively. The projection of stops 21–24 below the plane of transport system 11 assures that document 12 cannot slip through. Registration stops 21–24 are laterally-spaced along document registration unit 20 so that when document 12 is stopped at document registration position 16, the downstream edge 49 (see FIGS. 3 and 7) of document 12 is aligned with respect to document path 13 or, if desired, another path with which it is desired to align document 12, for example, one orthogonal to path 13. The continued travel of transport system 11 while document 12 is stopped assures that document 12 registers completely against stops 21–24. When it is time to release document 12, solenoid 27 is actuated to pivot registration stops 21–24 to position B (FIG. 3) wherein urge rollers 25 and 26 urge document 12 against transport belts 11A and 11B, thus increasing the frictional force between document 12 and transport system 11. The increased frictional force is enough to stop the slippage between document 12 and transport system 11 and moves document 12 downstream for further processing.

As document 12 moves in the downstream direction, it encounters exit pinch rollers 32 and 33 which are mounted on independent sets of support arms 34A, 34B and 35A, 35B, corresponding to exit pinch rollers 32 and 33, respectively, and which also pivot about pivoting axis 31. Arms 34A, 34B and 35A, 35B and thus rollers 32 and 33, are respectively spring biased by separate torsion springs (not shown) to urge rollers 32 and 33 against transport belts 11A and 11B. Rollers 32 and 33 move away from belts 11A and 11B when document 12 is released, but move back into engagement with transport system 11 as soon as document 12 is conveyed beyond rollers 32 and 33. The released document is thus urged against transport system 11 and driven while the next document is held. The mounting of pinch rollers 32 and 33 on separate support arms 34A, 34B and 35A, 35B results in minimal "shingling" of documents when a stack of documents exit the document registration apparatus. This is because rollers 32 and 33 and sets of arms 34A, 34B and 35A, 35B can move away from transport system 11 as required by the thickness of document 12 to allow document 12 to pass, without lifting the remainder of unit 20.

As shown in FIGS. 3 and 4, document registration unit 20 is preferably formed from one-piece document registration unit holder 45, to which a one piece frame 20B is pivotally attached. Frame 20B comprises stops 21–24 and arms 25A–B and 26A–B. Because document registration frame 20B is formed from a one-piece member, it is less subject to mechanical failure than registration devices formed from multiple interconnected parts. Furthermore, because registration stops 21–24 are rigidly and pivotally linked to urge rollers 25 and 26, it is not necessary to align registration stops 21–24 relative to urge rollers 25 and 26 in order for the overall document registration apparatus to be properly aligned. Registration stops 21–24 are inherently aligned with urge rollers 25 and 26 because urge rollers arms 25A, 25B, 26A and 26B are part of the same one-piece member as registration stops 21–24.

Figure 6:
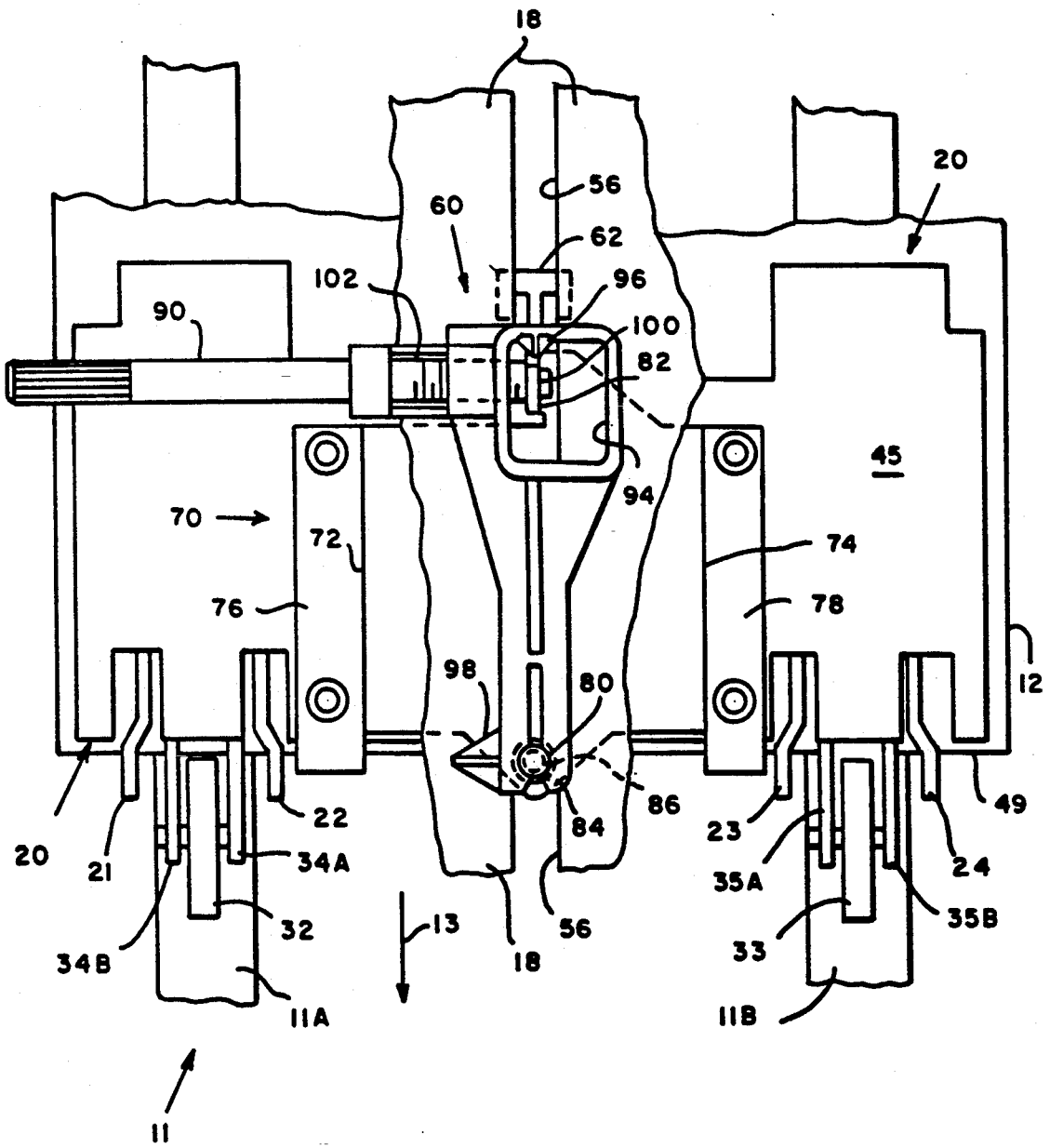
FIG. 6 is a top view of the document registration apparatus of FIG. 1.

Top plate 18, which is suitably mounted to the frame of the inserting machine (not shown), supports document registration unit 20 which is mounted to the underside of plate 18 (FIGS. 1 and 4). Top plate 18 includes a longitudinal slot 56 which guides a slide member 60 as it moves back and forth on top of plate 18. Slide member 60 comprises a rectangular tang 62 molded to its upstream end and a pin clamping section at its downstream end (FIG. 6). Tang 62 fits through a close fitting rectangular aperture 64 at slot 56 in top plate 18. By inserting tang 62 into aperture 64 and then sliding slide member 60 to the rear of plate 18, tang 62 is trapped under top plate 18, whereby slide member can be positioned on plate 18 along slot 56.

A U-shaped bracket 70 is suitably mounted to the top side of document registration unit 20. In the preferred embodiment of the present invention each leg 72 and 74 of bracket 70 includes a flange member 76 and 78 which is secured to registration unit 20 by screws. Solenoid 27 is fixedly mounted to one leg 76 of bracket 70. The top portion of bracket 70 includes a pin 80 in the middle of the downstream side of bracket 70, and a tab 82 in the middle of the upstream side.

Shaft 90 has a groove 100 at one end and a knurled surface at the other end. There is a threaded section 102 adjacent groove 100. Slide 60 includes a mating thread molded into it to accept threaded section 102 of shaft 90.

Bracket 70 is assembled to top plate 18 in the following manner. Bracket 70 is lifted up against the underside of plate 18 with pin 80 and tab 82 protruding through slot 56. Slide 60 includes a slotted clamp member 84 with a cutout portion 86 for retaining pin 80 and an aperture 94 through which tab 82 extends when bracket 70 is assembled to top plate 18. Slide 60 is positioned over slot 56 with clamp member 84 adjacent pin 80. Slide 60 is then slid forward causing pin 80 to be locked in place at cutout 86 of slotted clamp member 84 and tab 82 to be locked in place on groove 100. Thus registration unit 20 is slidably mounted to top plate 18.

Figure 7:
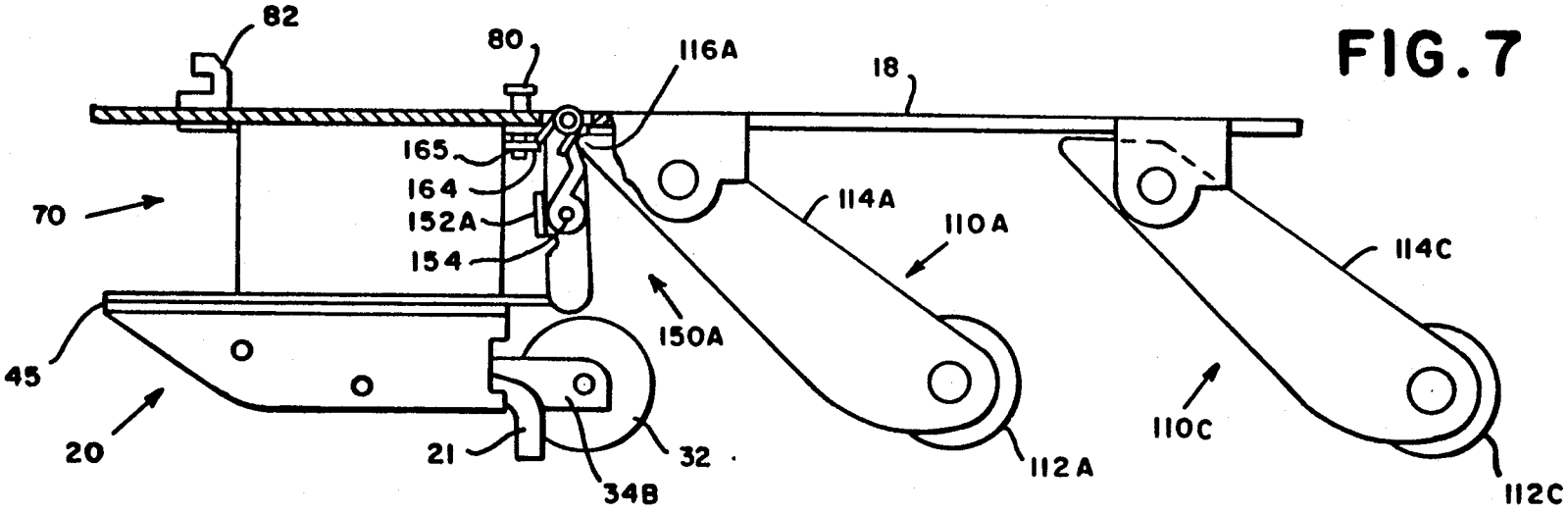
FIG. 7 is a partial side elevational view showing the registration apparatus of FIG. 1 arranged to handle a short document.

The pivotal adjustment about pin 80 is implemented by shaft 90. As best shown in FIG. 7, when shaft 90 is rotated clockwise, it is threaded into slide 60 causing groove 100 to move towards the rear of the machine. Tab 82 moves with groove 100 causing the pivotal rotation of the registration unit 20 around pin 80 in a clockwise direction. This causes the stops 21, 22, 23 and 24 and rollers 32 and 33 to rotate accordingly. It will be understood that rotating shaft 90 counter-clockwise has the opposite effect.

Slide 60 includes a pointer member 96 which indicates how much skew is introduced and the direction of the skew at registration apparatus 10. Slide 60 further includes a molded pointer 98 which indicates the length of insert the registration apparatus 10 can be adjusted to handle.

Slide 60 can be positioned longitudinally relative to slot 56 for the purpose of adjusting the position of the registration unit 20 for queuing and registering different sized documents. As previously indicated, registration apparatus 10 is suitable for use for the queuing and deskewing, full sized documents of various dimensions, e.g., $8\frac{1}{2}\times 11$ inches or $8\frac{1}{2}\times 14$ inches, or it may be used to handle different sized envelopes. Registration apparatus 10 includes the following structure which accommodates the adjustable positioning of registration unit 20 and maintains the integrity of the alignment of the document conveyed from registration unit 20.

It will be understood by those skilled in the art that for a queuing station handling only documents of a one length, the registration apparatus would have a fixed position registration unit. Such an apparatus would need only one set of pinch rollers. It has been discovered that for a registration apparatus 10 having an adjustable registration unit for handling documents of different lengths, one or more additional pinch roller assemblies are needed to ensure that normal force as maintained on document 12 as it is conveyed by belts 11A and 11B.

In the preferred embodiment of the present invention, there are a plurality of pinch roller assemblies pivotally mounted to both sides of top plate 18 for the purpose of ensuring that a normal force is maintained on document 12 against belts 11A and 11B as document 12 is conveyed from registration unit 20 for further processing.

The following description of the pinch roller assemblies in document registration apparatus 10 will refer to the registration apparatus 10 shown in FIGS. 2 and 7–10 comprising four sets of pinch roller assemblies suitable for handling documents between 3.75 to 14 inches in length. It will be understood by those skilled in the art that alternate configurations of registration apparatus 10 containing more than three pinch roller assemblies will operate and function in a similar manner, but will be suitable for documents of less than 3.75 inches in length.

Referring now to FIGS. 1 and 2, in addition to pinch rollers 32 and 33 that are part of registration unit 20, registration apparatus 10 includes three pairs of pinch roller assemblies 110A and 110B, 110C and 110D and 130. Each pinch roller assembly pair includes a pinch roller cooperating with one of transport belts 11A and 11B.

The most downstream pinch roller assembly 130 comprises a pair of pinch rollers 132 and 133 which are rotatably mounted to support arms 134 and 135, respectively. There is a frame member 140 comprising a center plate 142 and legs 144 and 145. Arms 134 and 135 are rigidly mounted to, or may be a molded part of center plate 142. Legs 144 and 145 are pivotally mounted to each side of top plate 18 in suitable manner, e.g., by pin and clip. Pinch rollers 132 and 133 are spring biased by spring 148 situation between the downstream end of top plate 18 and center plate 142. Pinch roller assembly 130 represents the last normal force applied by registration apparatus 10, as document 12 is conveyed from its control.

Pinch roller assembly 130 is always required for an adjustable registration apparatus. One or more additional pinch roller assembly pairs may be necessary depending on the minimum and maximum length of the document that is expected to be handled by the particular apparatus. The registration apparatus 10 shown in FIGS. 2, 7–10 is intended to handle documents between 3.75–14.5 inches in length. The remaining description of the preferred embodiment will focus on these figures.

Referring now to FIGS. 2 and 7–10, there are two interior pairs of pinch roller assemblies mounted to top plate 18. A first pair of pinch roller assemblies 110A and 110B are pivotally mounted to opposite sides of top plate 18 in a parallel relationship to pinch rollers 132 and 133. Approximately midway between the first pair of pinch roller assemblies 110A, 110B and the downstream pinch roller assembly 130 is a second pair of pinch roller assemblies 110C and 110D. Since the interior pinch roller assemblies 110A–D are comprised of the same structure, the following description of one pinch roller assembly without the designated letter will apply to each.

The pinch roller assembly 110 includes a roller 112 rotatably mounted to one of an independent support arm 114. The other end of support arm 114 is pivotally mounted to top plate 18 in a suitable manner, for example, by pin and clip. Arm 114 is spring biased by a torsion spring 116 to urge roller 112 against transport system 11. Arm 114 has a particular cam shape that causes arm 114 and, therefore, roller 112 to lift away from transport system 11 when the leading edge of registration unit 20 makes contact with the lower side of arm 114 as registration unit 20 is positioned in the downstream direction. In this manner, pinch roller 112 is moved up and out of the way of pinch rollers 32 and 33 as registration unit 12 is moved from an upstream position to a downstream position. Conversely, the cam shape of arm 114 causes pinch roller 112 to be lowered when registration unit 20 is returned to an upstream position.

Referring now to FIGS. 7–10, the adjustment of registration apparatus 10 for handling documents of different lengths will be described. As previously stated, the documents that will be handled in the preferred embodiment of the present invention are between 3.75 inches to 14.5 inches long. The documents are fed into apparatus 10 from left to right in FIGS. 7–10 on belts 11A and 11B. To ensure that the shortest document maintains contact with belts 11A and 11B, a normal force must be applied approximately every 3.5 inches to the documents directly against belts 11A and 11B. Thus, registration apparatus 10 includes four sets of pinch rollers. One set of pinch rollers is attached to registration unit 20, i.e., pinch rollers 32 and 33, so that they can be adjustably positioned relative to the length of document 12. The remaining sets of pinch rollers 112 A–D and 132 and 133 each have a fixed location in apparatus 10.

In FIG. 7, apparatus 10 is set up for a 4.5 inch long document based on the position of registration unit 20 relative to an upstream feeding device (not shown). For a longer document, registration unit 20 would be moved to the right, i.e., in a downstream direction, and conversely, adjusting registration unit 20 to the left, i.e., in an upstream direction, would facilitate the handling of a shorter document.

Figure 8:
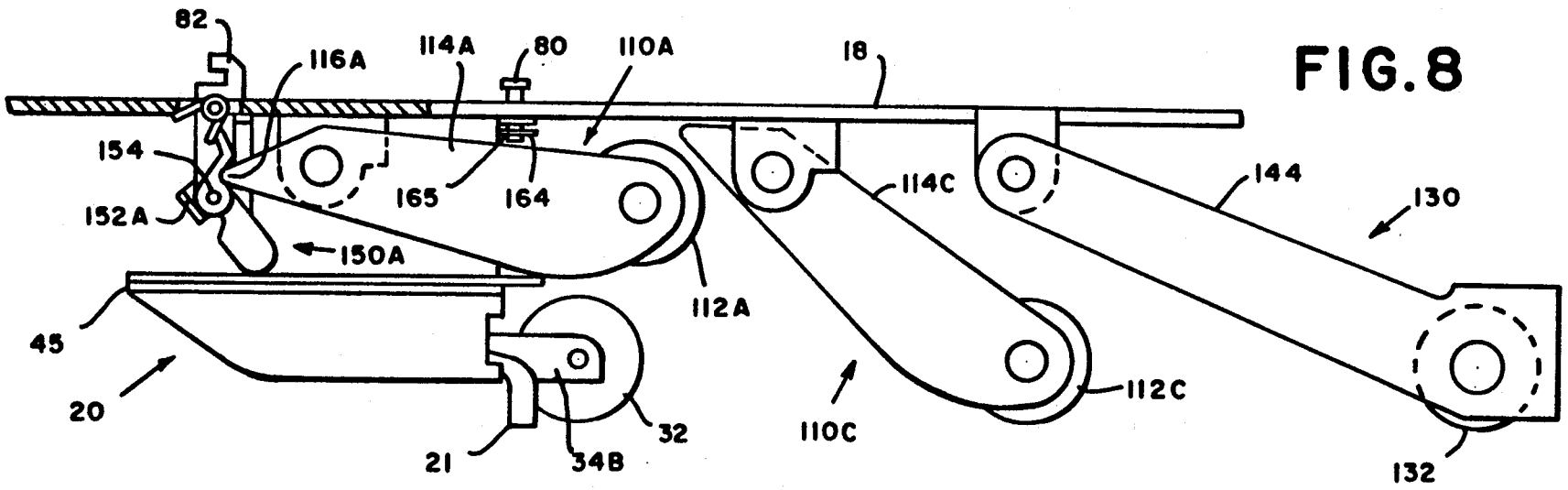
FIG. 8 is a partial side elevational view showing the registration apparatus of FIG. 1 arranged to handle a mid-length document.

When registration unit 20 is moved downstream for handling larger documents from the position shown in FIG. 7, pinch rollers 112A and 112B are lifted away from belts 11A and 11B, respectively, because of the cam shape of arms 114A and 114B which cause arms 114A and 114B to pivot about pins 118A and 118B, respectively. Rollers 112A and 112B are held in a raised position by arms 114A and 114B, since the cam surface of arms 114A and 114B are supported by the top of unit holder 45 for registration unit 20. When registration unit 20 has moved to the position shown in FIG. 8, arms 114A and 114B have been raised to a maximum height according to the cam shape of arms 114A and 114B and unit holder 45. At this point, tip members 116A and 116B of arms 114A and 114B snap into a notched portion of upper links 150A and 150B, respectively, which will hold arms 114A and 114B in the raised position until registration unit 20 is moved back to the left to disengage links 150A and 150B as described below. In FIG. 8, apparatus 10 is adjusted to handle 7.5 inch documents based on the position of registration unit 20 relative to an upstream feeding device (not shown).

Figure 9:
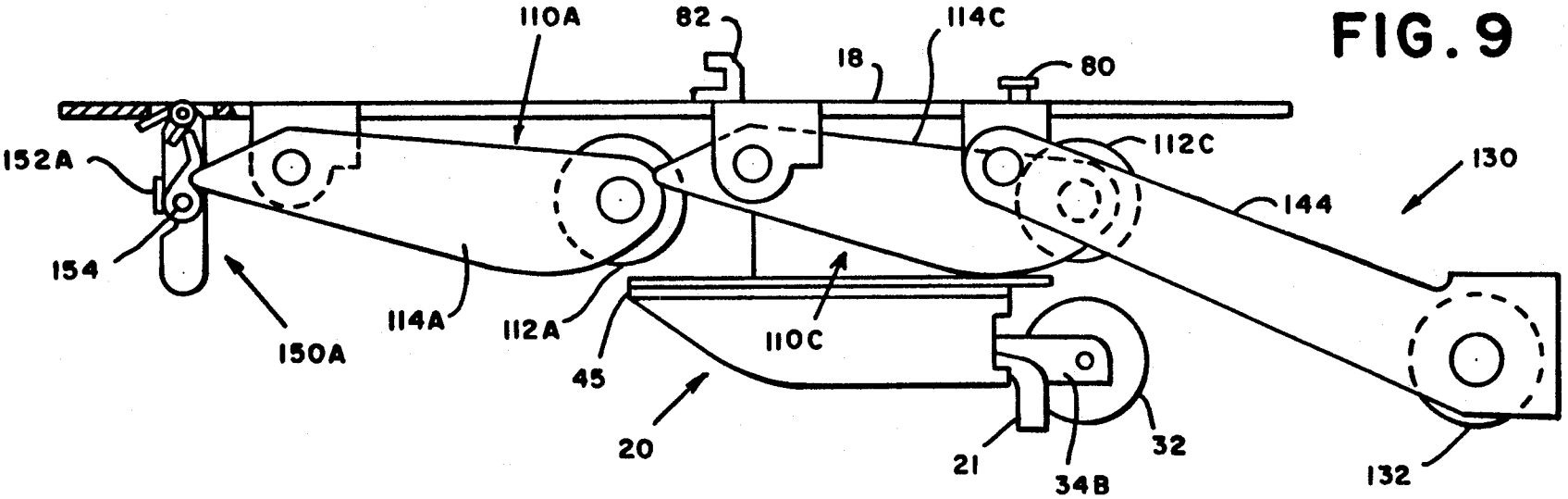
FIG. 9 is a partial side elevational view showing the registration apparatus of FIG. 1 arranged to handle a long document.

Referring now to FIG. 9, registration unit 20 has been moved even further downstream to handle 11 inch documents. Arms 114C and 114D and rollers 112C and 112D are raised into position as previously described for arms 114A and 114B and rollers 112A and 112B, except that arms 114C and 114D remain supported by unit holder 45 until registration unit 20 is returned to an upstream position. Since registration unit 20 cannot be moved downstream beyond contact with arms 114C and 114D, it is not necessary to lock them in a raised position as is necessary with arms 114A and 114B.

Figure 10:
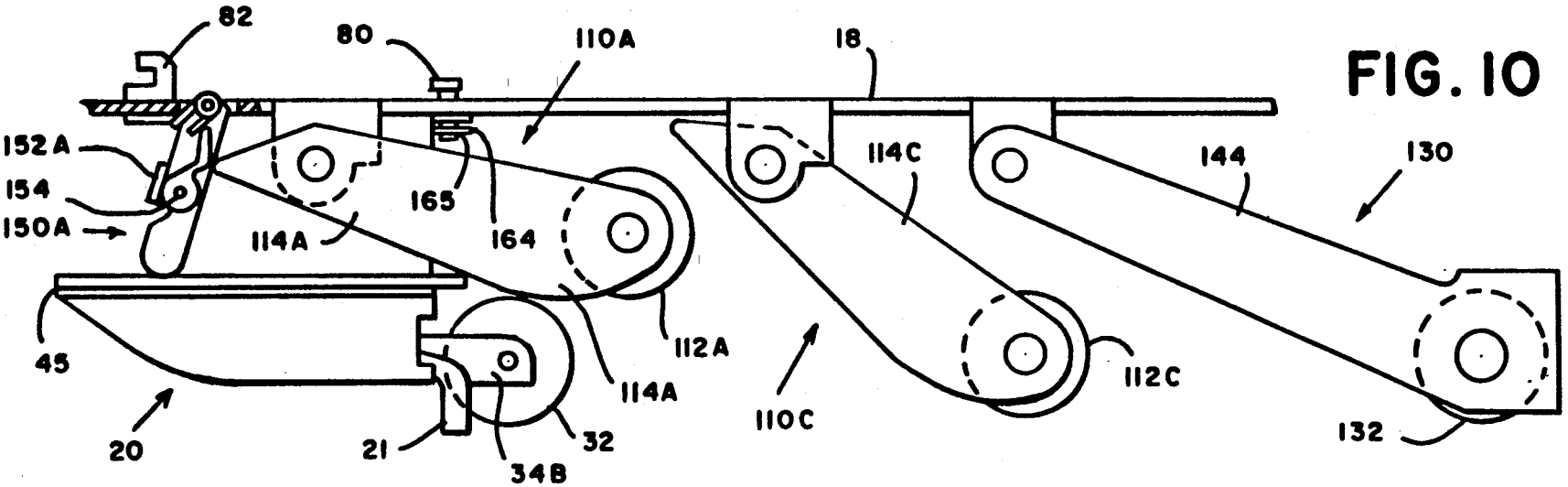
FIG. 10 is a partial side elevational view showing the registration apparatus of FIG. 1 being adjusted to handle a short document.

Referring now to FIG. 10, registration unit 20 has been moved to the left to handle shorter documents. Rollers 112C and 112D have been returned to a lowered position against transfer belts 11A and 11B. Unit holder 45 is under arms 114A and 114B that are being held in the raised position by braking links 150A and 150B. As registration unit 20 is moved to the left, unit holder 45 strikes breaking links 150A and 150B, allowing arms 114A and 114B to drop down onto unit holder 45 of registration unit 20.

Links 150A and 150B include tabs 152A and 152B which allow links 150 A and 150B to pivot about pins 154A and 154B when registration unit 20 is moved in the downstream direction, but which prevent links 150A and 150B from pivoting on pins 154A and 154B when unit 20 is moved in the upstream direction, as shown in FIGS. 8 and 10 respectively. When unit holder 45 hits links 150A and 150B as registration unit 20 is moved in the upstream direction, this causes links 150A and 150B each to pivot clockwise about pins 155A and 155B, respectively, causing arm tips 116A and 116B to disengage from the notched sections of 150A and 150B. This allows arms 114A and 114B to drop against unit holder 45, causing rollers 112A and 112B to be lowered to transport belts 11A and 11B as registration unit 20 is moved further upstream.

Referring again to FIG. 10, registration unit 20 has been moved far enough to the left that arms 114C and 114D have slid down off unit holder 45 of registration unit 20, causing rollers 112C and 112D to be lowered until they are fully lowered against belts 11A and 11B, respectively, thereby providing a normal force to the documents as they are conveyed through apparatus 10.

Referring now to FIG. 2, in the preferred embodiment of the present invention, registration unit 20 is moved upstream and downstream by rotating knob 160 that is secured to shaft 162 having a turning pulley 166 secured thereon. There is a timing belt 168 which is threaded through a mounting clip 164. Timing belt 166 is attached to mounting bracket 70 by placing aperture 165 in mounting clip 164 over pin 80 which is locked into cut out 86 of slide 60 as previously described. Thus, is registration unit 20 is moved downstream by rotating knob 160 clockwise, and conversely registration unit 20 is moved upstream by rotating knob 160 counterclockwise.

Thus it is seen that the present invention provides sheet length adjustment means to a document registration apparatus that has a design that does not result in frequent mechanical failure, that has minimum number of mechanical parts, that can simultaneously align a stack of documents without shingling, and that includes skew adjustment means. One skilled in the art will appreciate that the present invention can be practiced by other than the described embodiments, which are presented for purposes of illustration and not of limitation, and the present invention is limited only by the claims which follow.

What is claimed is:

1. A document registration apparatus for use with conveying means for transporting a document along a path from an upstream direction to a downstream direction through a document registration position, said document registration apparatus comprising:

a document registration unit positioned above a document registration position in the document path, having:

a plurality of laterally-spaced registration stops at a downstream end of said registration unit positioned substantially perpendicular to the document path for both stopping a document at the document registration position and for aligning the document relative to the document path when said stops are lowered adjacent to the document path;

first pivoting means for pivoting said registration stops about a horizontal axis in said registration unit for selectively lowering said stops adjacent to the document path and . raising said stops whereby conveying means transport said document from said registration position; and a plurality of unit pinch rollers positioned adjacent to and downstream from the laterally-spaced registration stops for urging the document against the conveying means as the document is conveyed away from the document registration position in the downstream direction; the document registration apparatus further comprising:

a top plate having a longitudinal slot, said registration unit being mounted to said top plate by a bracket extending through said slot;

a plurality of exit pinch rollers pivotally mounted to a downstream section of said top plate for urging the document against the conveying means as the document is conveyed away from the document registration apparatus; and adjustment means operatively connected to said bracket for moving said bracket along said slot wherein said document registration unit is moved to a position within the document registration apparatus for handling a particular length of the document.

2. The apparatus of claim 1 further comprising at least one pair of interior pinch rollers that are individually mounted to one end of respective support arms, the other end of said support arms being pivotally mounted to said top plate.

3. The apparatus of claim 2 wherein said support arms have a cam shape for raising said interior pinch rollers away from said conveying means, when said registration unit strikes said support arms as said registration unit is move in the downstream direction, said cam shape of said support arms being suitable for said registration unit sustaining said support arms in a raised position while said support arms are in contact with said registration unit.

4. The apparatus of claim 3 further comprising means for locking said support arms in said raised position after said registration unit is moved in a downstream direction past said support arms.

5. The apparatus of claim 4 wherein said locking means include means for releasing said support arms from said raised position when said registration unit strikes said locking unit as said registration unit is moved in an upstream direction.

6. The apparatus of claim 1 further comprising second pivoting means for pivoting said documentation registration unit about a vertical axis for skew adjustment of said registration unit.

7. The apparatus of claim 6 wherein said bracket includes a pin defining said vertical axis at a downstream end of said bracket and a tab at an upstream end of said bracket, said pin and said tab extending through said slot in said top plate, said second pivoting means including means above said top plate for pivotally securing said pin, said slot being suitable for moving said tab in one of a clockwise and counterclockwise direction about said pin.

8. The apparatus of claim 7 wherein said second pivoting means further includes means for selectively moving said tab a desired distance in one of the clockwise and counterclockwise direction for said skew adjustment.

9. The apparatus of claim 1 wherein the first pivoting means comprises a rotary solenoid mounted to said bracket.

10. The apparatus of claim 1 wherein the laterally-spaced registration stops comprise two sets of two stops per set.

11. The apparatus of claim 10 wherein associated with each of said set of registration stops is a corresponding urge roller longitudinally aligned with its corresponding set of registration stops.

12. The apparatus of claim 11 wherein for each of said urge rollers, the document registration unit further comprises two corresponding urge roller arms.

13. The apparatus of claim 12 wherein said urge roller arms and the laterally-spaced registration stops are formed from the same one-piece member.

14. The apparatus of claim 1 wherein the unit pinch rollers are independently pivotally attached to the document registration unit horizontal axis.

15. A document registration apparatus for use with conveying means for transporting a document along a path from an upstream direction to a downstream direction through a document registration position, said document registration apparatus comprising:

a document registration unit positioned above a document path adjacent to the document registration position, having:

an upstream end, a downstream end and a horizontal axis positioned in between the upstream end and the downstream end;

a plurality of laterally-spaced registration stops at the downstream end of the unit positioned substantially perpendicular to the document path for both stopping a document at the document registration position and for aligning the document relative to the document path when said stops are pivoted adjacent to the document path, at least one urge roller at the upstream end of the unit for urging a stopped document against the conveying means when said stops are pivoted away from the document path to move the document from the document registration position in the downstream direction; and first pivoting means for pivoting said registration stops about a horizontal axis in said registration unit for selectively lowering said stops adjacent to the document path and raising said stops whereby said conveying means transports said document from said registration position;

a plurality of unit pinch rollers positioned adjacent to and downstream from the laterally-spaced registration stops for urging the document against the conveying means as the document is conveyed away from the document registration position in the downstream direction; the document registration apparatus further comprising:

a top plate having a longitudinal slot, said registration unit being mounted to said top plate by a bracket extending through said slot;

a plurality of exit pinch rollers pivotally mounted to a downstream section of said top plate for urging the document against the conveying means as the document is conveyed away from the document registration apparatus; and adjustment means operatively connected to said bracket for moving said bracket along said slot wherein said document registration unit is moved to a position within the document registration apparatus for handling a particular length of the document.

16. The apparatus of claim 15 further comprising at least one pair of interior pinch rollers that are individually mounted to one end of respective support arms, the other end of said support arms being pivotally mounted to said top plate.

17. The apparatus of claim 16 wherein said support arms have a cam shape for raising said interior pinch rollers away from said conveying means, when said registration unit strikes said support arms as said registration unit is move in the downstream direction, said cam shape of said support arms being suitable for said registration unit sustaining said support arms in a raised position while said support arms are in contact with said registration unit.

18. The apparatus of claim 17 further comprising means for locking said support arms in said raised position after said registration unit is moved in a downstream direction past said support arms.

19. The apparatus of claim 18 wherein said locking means include means for releasing said support arms from said raised position when said registration unit strikes said locking unit as said registration unit is moved in an upstream direction.

20. The apparatus of claim 20 wherein said bracket includes a pin defining said vertical axis at a downstream end of said bracket and a tab at an upstream end of said bracket, said pin and said tab extending through said slot in said top plate, said second pivoting means including means above said top plate for pivotally securing said pin, said slot being suitable for moving said tab in one of a clockwise and counterclockwise direction about said pin.

21. The apparatus of claim 20 wherein said second pivoting means further includes means for selectively moving said tab a desired distance in one of the clockwise and counterclockwise direction for said skew adjustment.

22. The apparatus of claim 21 wherein the first pivoting means comprises a rotary solenoid mounted to said bracket.

23. The apparatus of claim 22 wherein the laterally-spaced registration stops comprise two sets of two stops per set.

24. The apparatus of claim 23 wherein associated with each set of registration stops is a corresponding urge roller longitudinally aligned with its corresponding set of registration stops.

25. The apparatus of claim 24 wherein for each urge roller, the document registration unit further comprises two corresponding urge roller arms.

26. The apparatus of claim 25 wherein the urge roller arms and the laterally-spaced registration stops are formed from the same one-piece member.

27. The apparatus of claim 26 wherein the exit pinch rollers are independently pivotally attached to the document registration unit horizontal axis.

28. The apparatus of claim 15 further comprising second pivoting means for pivoting said documentation registration unit about a vertical axis for skew adjustment of said registration unit.

* * * * *